United States Patent [19]

Roark

[11] Patent Number: 4,957,164

[45] Date of Patent: Sep. 18, 1990

[54] ENHANCED OIL RECOVERY USING FLASH-DRIVEN STEAMFLOODING

[75] Inventor: Steven D. Roark, Bartlesville, Okla.

[73] Assignee: IIT Research Institute, Chicago, Ill.

[21] Appl. No.: 339,148

[22] Filed: Apr. 17, 1989

[51] Int. Cl.[5] ..... E21B 43/24

[52] U.S. Cl. ..... 166/263; 166/272

[58] Field of Search ..... 166/263, 272, 303

[56] References Cited

U.S. PATENT DOCUMENTS

| | | | |
|---|---|---|---|
| 3,771,598 | 11/1973 | McBean | 166/272 X |
| 3,796,262 | 3/1974 | Allen et al. | 166/272 |
| 3,847,219 | 11/1974 | Wang et al. | 166/263 |
| 4,121,661 | 10/1978 | Redford | 166/272 X |
| 4,271,905 | 6/1981 | Redford et al. | 166/263 |
| 4,324,291 | 4/1982 | Wong et al. | 166/263 X |
| 4,429,745 | 2/1984 | Cook | 166/263 |
| 4,635,720 | 1/1987 | Chew | 166/263 X |

*Primary Examiner*—George A. Suchfield
*Attorney, Agent, or Firm*—Fitch, Even, Tabin & Flannery

[57] ABSTRACT

The present invention is directed to a novel steamflooding process which utilizes three specific stages of steam injection for enhanced oil recovery. The three stages are as follows: As steam is being injected into an oil-bearing reservoir through an injection well, the production rate of a production well located at a distance from the injection well is gradually restricted to a point that the pressure in the reservoir increases at a predetermined rate to a predetermined maximum value. After the maximum pressure has been reached, the production rate is increased to a value such that the predetermined maximum pressure value is maintained. Production at maximum pressure is continued for a length of time that will be unique for each individual reservoir. In some cases, this step of the steamflooding process of the invention may be omitted entirely. In the third stage of the steamflooding process of the invention, production rates at the producing well are increased gradually to allow the pressure to decrease down from the maximum pressure value to the original pressure value at the producing well. The rate of pressure reduction will be unique for each reservoir. After completing stage three, the three stages can be repeated or the steamflood may be terminated as considered desirable.

3 Claims, 5 Drawing Sheets

| | | | | | | | |
|---|---|---|---|---|---|---|---|
| 177.54 | 196.56 | 218.57 | 250.54 | 318.04 | 337.03 | 339.81 | 339.81 |
| 177.54 | 194.45 | 217.58 | 248.36 | 291.91 | 331.10 | 342.01 | 339.81 |
| 175.54 | 192.35 | 215.48 | 237.49 | 274.49 | 309.33 | 342.01 | 342.01 |
| 175.54 | 190.25 | 211.27 | 235.28 | 263.60 | 291.91 | 339.81 | 339.81 |

STEAM FRONT

| | | | | | | | |
|---|---|---|---|---|---|---|---|
| 187.20 | 210.33 | 286.93 | 337.01 | 337.01 | 337.01 | 339.19 | 339.19 |
| 187.20 | 210.33 | 259.43 | 337.01 | 339.19 | 337.01 | 339.19 | 337.01 |
| 185.10 | 206.12 | 237.56 | 291.29 | 337.01 | 337.01 | 339.19 | 339.19 |
| 180.90 | 199.82 | 225.04 | 280.40 | 337.01 | 337.01 | 339.19 | 339.19 |

STEAM FRONT

× THERMOCOUPLE POINTS

FIG. 2A

| | | | | | | | |
|---|---|---|---|---|---|---|---|
| 245.78 | 298.04 | 338.17 | 338.17 | 338.17 | 340.34 | 340.34 | 340.34 |
| 245.78 | 287.15 | 338.41 | 338.17 | 340.34 | 340.34 | 340.34 | 340.34 |
| 239.25 | 274.09 | 319.81 | 331.53 | 340.34 | 340.34 | 342.54 | 340.34 |
| 232.89 | 258.85 | 302.40 | 333.81 | 338.17 | 340.34 | 340.34 | 340.34 |

STEAM FRONT

FIG. 2B

| | | | | | | | |
|---|---|---|---|---|---|---|---|
| 329.06 | 335.59 | 336.70 | 336.70 | 336.70 | 336.70 | 338.68 | 338.80 |
| 322.53 | 337.77 | 337.77 | 336.70 | 338.88 | 336.70 | 338.88 | 338.88 |
| 270.27 | 336.59 | 337.77 | 332.35 | 338.88 | 338.88 | 338.88 | 338.88 |
| 248.49 | 329.06 | 337.77 | 336.70 | 336.70 | 338.88 | 338.88 | 338.88 |

STEAM FRONT

FIG. 2C

| | | | | | | | |
|---|---|---|---|---|---|---|---|
| × | × | × | × | × | × | × | × |
| × | × | × | × | × | × | × | × |
| × | × | × | × | × | × | × | × |
| × | × | × | × | × | × | × | × |

× THERMOCOUPLE POINTS

ENHANCED OIL RECOVERY USING FLASH-DRIVEN STEAMFLOODING

FIELD OF THE INVENTION

The present invention relates to the recovery of oil from subterranean reservoirs using steam as a recovery agent. More particularly, the present invention is directed to a method for utilizing steam for oil recovery in a series of specific stages whereby in the final stage, hot water is flashed to steam within the reservoir and becomes a substantial force for driving fluid flow.

BACKGROUND OF THE INVENTION

In the recovery of oil from subterranean, oil-bearing formations, it is only possible to recover a portion of the original oil present in the reservoir by primary recovery methods which utilize the natural formation pressure or pumps to produce the oil through suitable production wells. For this reason, a variety of enhanced recovery techniques have been developed which are directed either to maintaining formation pressure or to improving the displacement of the oil from the porous rock matrix. Steamflooding is a well-known, enhanced recovery technique. Several types of steamflooding methods are known. In the widely used steam-soak process, steam is injected into one well and oil is produced from the same well. During the steam injection stage of the steam-soak method, an oil bank forms ahead of the steam front and is driven away from the injection well. During the production stage of the steam-soak method, where some flashing of hot water to steam occurs, all fluid flow and heat flow are directed towards the section of the reservoir containing the least amount of oil, i.e. the well into which the steam has been injected and from which the oil must now be recovered.

Multi-well steamflooding processes are also known wherein steam is introduced into the oil-bearing reservoir through means of an injection well and is recovered from one or more production wells located at a distance from the injection well. In such known, conventional steamflooding processes, an external source of steam, such as a boiler, is used continuously as the source of steam injected into the injection well and is the only means of steam propagation throughout the reservoir. That is, steam is injected through the injection well at a continuous pressure and this pressure is used as the driving force to move oil through the oil-bearing reservoir and to subsequent removal through the production well.

The present invention is directed to a novel steamflooding process which is cost-effective when compared with conventional steamflooding or steam-soak processes by either producing more oil with the same amount of heat input or by producing the same amount of oil with a lesser quantity of steam.

SUMMARY

The present invention is directed to a novel steamflooding process which utilizes three specific stages of steam injection for enhanced oil recovery. The three stages are as follows:

1. As steam is being injected into an oil-bearing reservoir through an injection well(s), the production rate of a production well located at a distance from the injection well(s) is gradually restricted to a point that the pressure in the reservoir increases at a predetermined rate to a predetermined maximum value. In some cases, production could be completely shut off, however, a reduced production rate is preferred.

2. After the maximum pressure has been reached, the production rate is increased to a value such that the predetermined maximum pressure value is maintained. Production at maximum pressure is continued for a length of time that will be unique for each individual reservoir. In some cases, this step of the steamflooding process of the invention may be omitted entirely.

3. In the third stage of the steamflooding process of the invention, production rates at the producing well are increased gradually to allow the pressure to decrease down from the maximum pressure value to the original pressure value at the producing well. The rate of pressure reduction will be unique for each reservoir. In some cases, the steam injection rate may be altered during the time at which the production rate is increased or, alternatively, steam injection into the injection well may be halted completely. In the preferred method, steam injection is continued through the injection well at the same rate as in the first two stages. The third stage is continued until pressure in the reservoir approaches the pressure observed at the beginning of steam injection. After completing stage three, the three stages can be repeated or the steamflood may be terminated as considered desirable.

BRIEF DESCRIPTION OF THE DRAWINGS

FIG. 2 is a schematic diagram of a two-dimensional steamflood model and final temperatures for a second set of steamflooding examples;

DETAILED DESCRIPTION OF THE INVENTION

Figures 1A, 1B, 1C:
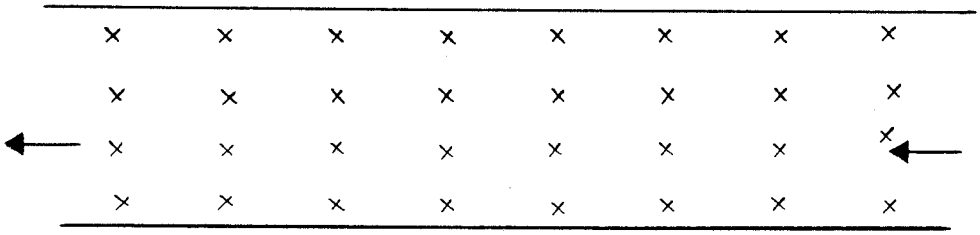
FIG. 1 is a schematic diagram of a two-dimensional steamflood model and final temperatures for a set of steamflooding examples.

The present invention is directed to a method for recovery of oil from a subterranean oil-bearing formation by injecting steam into the formation through an injection well(s) and recovering oil from one or more production wells located at a distance from the injection well(s). In the method, steam is injected through an injection well into an oil-bearing formation. As the steam is injected through the injection well(s), the production rate of oil recovered from one or more production wells located at a distance from the injection well is gradually reduced so that the pressure in the formation increases at a predetermined rate from an original value to a predetermined maximum value. After the maximum pressure value has been reached, injection of steam through the injection well is continued after the production rate of oil recovered from the production well is increased to a value such that the maximum pressure value is maintained. The injection of steam at the maximum pressure value is continued for a predetermined time and, in some cases, there need not be any continued injection of steam after the maximum pressure value is reached. Thereafter, the production rate of oil from the production well is gradually increased so that the pressure in the formation decreases at a predetermined rate from the maximum value back down to the original value of the production well.

It should be understood that the rate in increase of pressure during the first stage, the maximum pressure value attained during the first stage and the rate of pressure reduction during the third stage will vary over a wide range of values depending upon the distance of the injection well from the production wells, the nature of the rock formation in which the oil is located, the original pressure value at the production well, and the size of the boiler available to produce steam for injection into the injection well. Very generally, it can be said that the rate of pressure increase during stage one will be in the range of from about 5 to about 50 psi/day and the maximum pressure value attained in stage one will be in the range of from about 50 to about 2,000 psia. The rate of pressure reduction in stage three will generally range from about 5 to about 50 psi/day. Original pressure values at the production well will generally be in the range of from about 500 to about 2,000 psia.

There are a number of differences between a conventional steamflood and the flash-driven steamflooding process of the invention. During the first stage of the process the reservoir is heated at a slower rate than the conventional steamflood because of the 'shutting-in', effect of the reservoir. In the second stage, production rates are comparable to the conventional method. However, latent heat losses are reduced as a result of the steam zone being initially confined to a smaller volume at higher pressure. This confinement reduces the surface area in which condensation can occur. Another benefit is the decreased viscosity of the oil in the vicinity of the steam zone because of the use of higher temperature steam.

During the third stage, the flashing of hot water to steam within the reservoir becomes a substantial force for driving fluid flow. In comparison, conventional multi-well steamfloods use an external source of steam as the only means of steam propagation While higher pressure steam is required through most of the process of the invention, the overall energy consumption of the boiler is reduced. As pressure is lowered in stage three, a constant lowering of the boiling point of water also occurs. Hot water near the steam zone spontaneously flashes (evaporates) to steam, creating a large volume expansion which drives fluid flow in the direction of the producing well. Rapid progression of the steam front through the reservoir during the flashing process increases the heat transferred in the direction of the producing well as compared to heat lost to adjacent rock layers. Latent heat losses by condensation are virtually eliminated in stage three because of the constant lowering of the boiling point. Gravity override, which is the tendency of the steam zone to progress faster along the top of the reservoir than at the bottom, is reduced during this stage because of the elimination of water drainage from condensation at the steam front. Reduction in gravity override is the goal of many thermal enhanced oil recovery projects.

While flash-driven steamflooding is an economic process for recovering both light and heavy oils, steamflooding of light oil reservoirs is the preferred process. This is based on the fact that recovery by steam distillation, which is the vaporization of the lighter components of crude, will be enhanced in both stage two and three of the process. As shown in studies by Farouq Ali, et al., "Practical Consideration in Steamflooding," Producers Monthly (Jan. 1968) pp. 13–16, it is estimated that as much as 60% of oil recovery in light oil steamfloods may be attributed to the steam distillation mechanism. Willman, et al. "Laboratory Studies of Oil Recovery by Steam Injection," J. Pet. Tech. (July 1961) pp. 681–690, found that oil recoveries by steam distillation increased for both light and heavy oils as steam pressure and temperature increased. These conditions exist throughout stage two of the process of the invention. In stage three, as the pressure is lowered, superheated conditions exist in certain regions of the reservoir. The probability of superheated conditions will be greatest as distance from the injection well decreases. Wu, C. H., et al., "A Laboratory Study on Steam Distillation in Porous Media," SPE Paper 5569 pres. at the 1975 SPE Annual Tech. Conf. and Exhib., Dallas, TX, September 28–Oct. 1, have shown significant increases in oil recoveries with the steam distillation mechanism using superheated steam. An increased recovery attributable to gas-driven and solvent-extraction effects is also attained.

EXAMPLE

Laboratory data have shown that steam can be successfully propagated through a two-dimensional steamflood model using the method of the invention. Furthermore, it has been demonstrated that the steam zone within the reservoir progressed a greater distance as compared to conventional steamfloods, covering 35% more volume of the formation in one run and 100% more in another run while using 5.2% and 5.1% less energy, respectively. Another two runs were conducted to compare oil production of the two techniques along with energy input to the reservoir. In the flash-driven run, the three stages previously described were repeated three times. The results of both methods showed an increased oil recovery of 10.9% of the original oil in place using the method of the invention while requiring 5.4% less energy than the conventional steamflood run. Stage three in each of the flash-driven steamfloods was marked with a rapid increase in oil production, as well as a significant drop in the water-oil ratio. The water-oil ratio is often used as an economic guide in steamfloods, with a lower ratio corresponding to more favorable economic conditions. A summary of laboratory data obtained from the six steamfloods, three using conventional techniques and three using the flash-driven technique of the invention is set forth herein below.

Three sets of runs were conducted using the two-dimensional steamflood model schematically depicted in FIGS. 1 and 2. Each set consisted of a conventional steamflood followed by a steamflood using the flash-driven steamflooding method. Other parameters were duplicated to achieve repeatability.

The goal in the first set of steamfloods was to determine how far the steam zone would progress in the model in a given time period using conventional and flash-driven steamflooding. In order to duplicate reservoir conditions, the same sandpack was used (2.3 darcies) in both runs. After saturating the sandpack with a 2% brine, Murphy East Poplar Unit crude (40° API Gravity) was pumped through the model until connate water saturation, (the irreducible water saturation) was reached. The model's insulation was not removed between runs in order to eliminate the possibility of having different rates of heat transfer in the two runs. Room temperature for the two runs was within a three degree F. range. The steam mass flow rate (m) was 0.551 lbm/hr for the conventional steamflood and 0.532 lbm/hr for the flash-driven steamflood. The conventional steamflood was run at 100 psig for 9 hours. The flash-driven steamflood was run at 100 psig for 100 minutes followed by a ramping stage for 80 minutes allowing the pressure to increase 1 psi per minute until 80 psig was reached. This pressure was held for five hours at which time the production rate was increased to allow a pressure reduction of 1.33 psi per minute. This reduction continued until the reservoir pressure was at 100 psig which corresponded to the end of the 9-hour conventional steamflood experiment. Final temperatures for both the conventional and flash-driven steamfloods are given in FIG. 1 along with a schematic diagram of the two-dimensional steamflood model used in the tests. Any thermocouple reading greater than 335° F. can be considered to be within the steam zone. The flash-driven steamflood has contacted at least 100% more of the formation with steam than the conventional steamflood while using 5.2% less energy. Table 1 below contains the amount of energy consumed by the boiler (columns 1 and 2). The efficiency of the oven was considered to be 100% since the same boiler was used for both techniques. Therefore, energy values are taken to be the change in the enthalpy of the cold water pumped into the boiler as compared to the enthalpy of the steam leaving the boiler.

TABLE 1

ENERGY REQUIREMENTS FOR BOILER, BTU/lb

| TIME | Set 1 | | Set 2 | | Set 3 | |
|---|---|---|---|---|---|---|
| (hour) | *$h_1$ | *$h_2$ | *$h_3$ | *$h_4$ | *$h_5$ | *$h_6$ |
| 1 | 1250.9 | 1223.9 | 1230.9 | 1193.2 | 1181.1 | 1201.2 |
| 2 | 1272.6 | 1248.6 | 1254.8 | 1210.1 | 1250.5 | 1229.2 |
| 3 | 1278.9 | 1257.1 | 1273.4 | 1233.8 | 1266.1 | 1222.6 |
| 4 | 1287.4 | 1269.4 | 1280.5 | 1261.6 | 1276.4 | 1247.1 |
| 5 | 1288.7 | 1270.7 | 1283.2 | 1271.6 | 1280.0 | 1243.0 |
| 6 | 1289.1 | 1253.5 | 1286.1 | 1274.3 | 1281.8 | 1251.1 |
| 7 | 1289.9 | 1269.3 | 1288.0 | 1266.9 | 1283.2 | 1283.5 |
| 8 | 1291.8 | 1273.0 | 1287.7 | 1275.6 | 1286.8 | 1278.3 |
| 9 | 1296.1 | 1279.2 | 1290.3 | 1272.8 | 1287.6 | 1278.0 |
| 10 | | 1292.1 | 1272.9 | 1286.9 | 1275.7 | |
| 11 | | 1292.0 | 1275.1 | 1287.5 | 1284.6 | |
| 12 | | 1295.3 | 1286.0 | 1287.7 | 1284.7 | |
| 13 | | | | 1285.3 | 1280.9 | |
| 14 | | | | 1289.2 | 1285.0 | |
| 14.5 | | | | | 1289.4 | |
| TOTAL (BTU's) | 6,133 | 5,815 | 8,156 | 7,736 | 10,518 | 9,946 |

*h = enthalpy of steam $\frac{BTU}{lb}$ at boiler outlet.

NOTE:

Energy values for conventional steamfloods are $h_1$, $h_3$, $h_5$. Flash-driven steamfloods values are $h_2$, $h_4$, and $h_6$.

Sample calculation — $(h_1)$ avg = 1282.8 BTU/$lb_m$ — (h) cold water = 46.0 BTU/$lb_m$ $(h_1)$ avg = 1282.8 − 46.0 = 1236.8 BTU/$lb_m$ TOTAL = $BTU = *_{h1}$(1236.8 BTU/lb)(0.551$_m$lb water/hour$_m$)(9.0 hours) = 6133 BTU The second set of steamfloods was an identical repeat of the first set with the following exceptions:

1. Duration of experiment: 12 hours,
2. Hourly water-oil ratios determined,
3. Duration of Stage 2 in the flash-driven steamflood: 9 hours.

Figure 3:
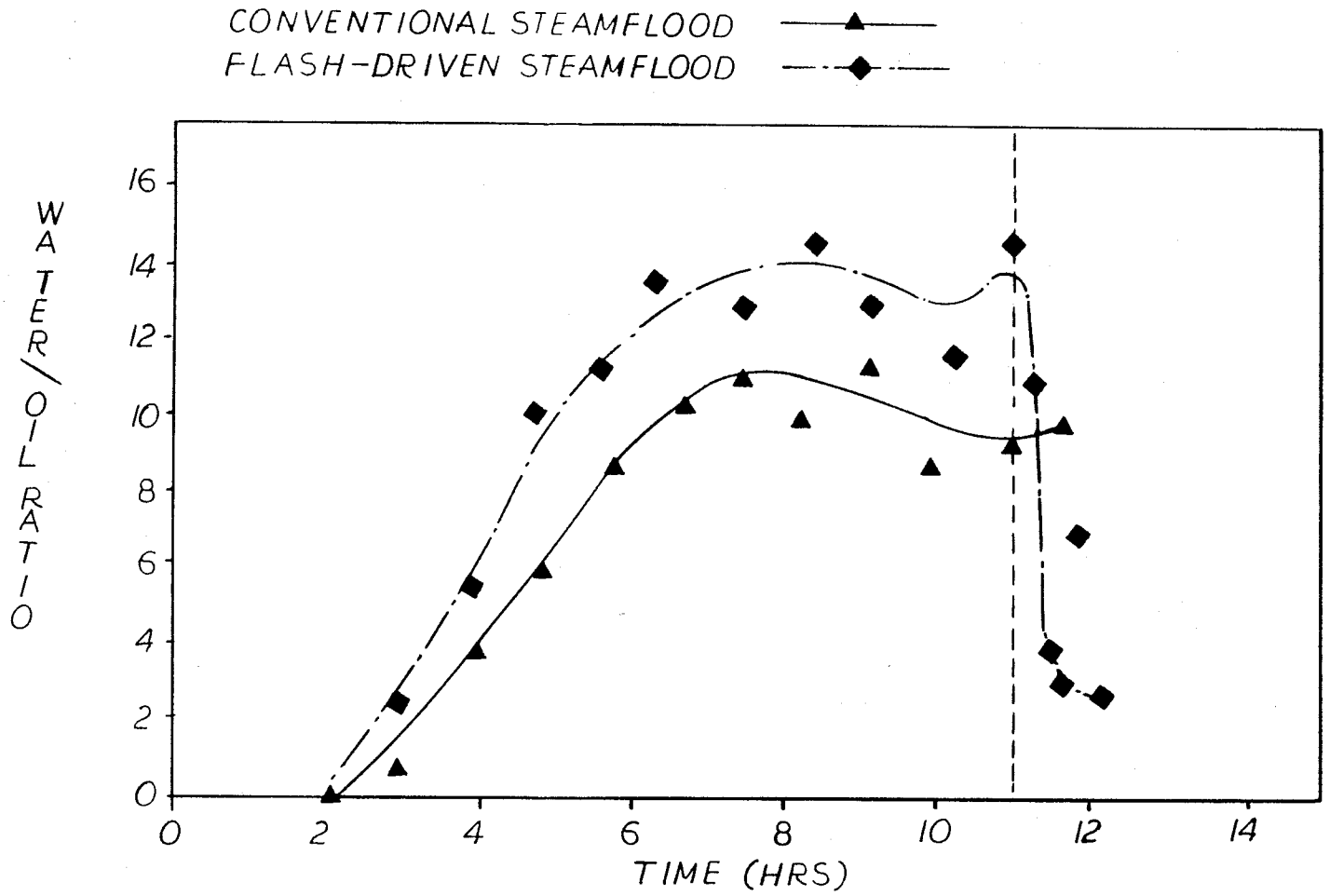
FIG. 3 is a comparison of water and oil ratios between conventional steamflooding and the flash-driven steamflooding of the present invention.

The temperature profiles for the second set of steamfloods are illustrated in FIG. 2. The amount of the formation contacted by the steam in the flash-driven steamflood was approximately 35% more than the conventional steamflood (while using 5.1% less energy). Energy requirements for both methods are summarized in Table 1 (columns 3 and 4). FIG. 3, which is a plot of the hourly water-oil ratios, illustrates the dramatic drop in the water-oil ratio during the last hour of the run. This hour corresponds to the time in which Stage 3 of the process of the invention is being conducted. During Stage 3 of the process the production was increased by at least 200% to allow the required pressure reduction. Therefore, not only was the ratio of water to oil improved, the total amount of water and oil produced was more than tripled.

Figure 4:
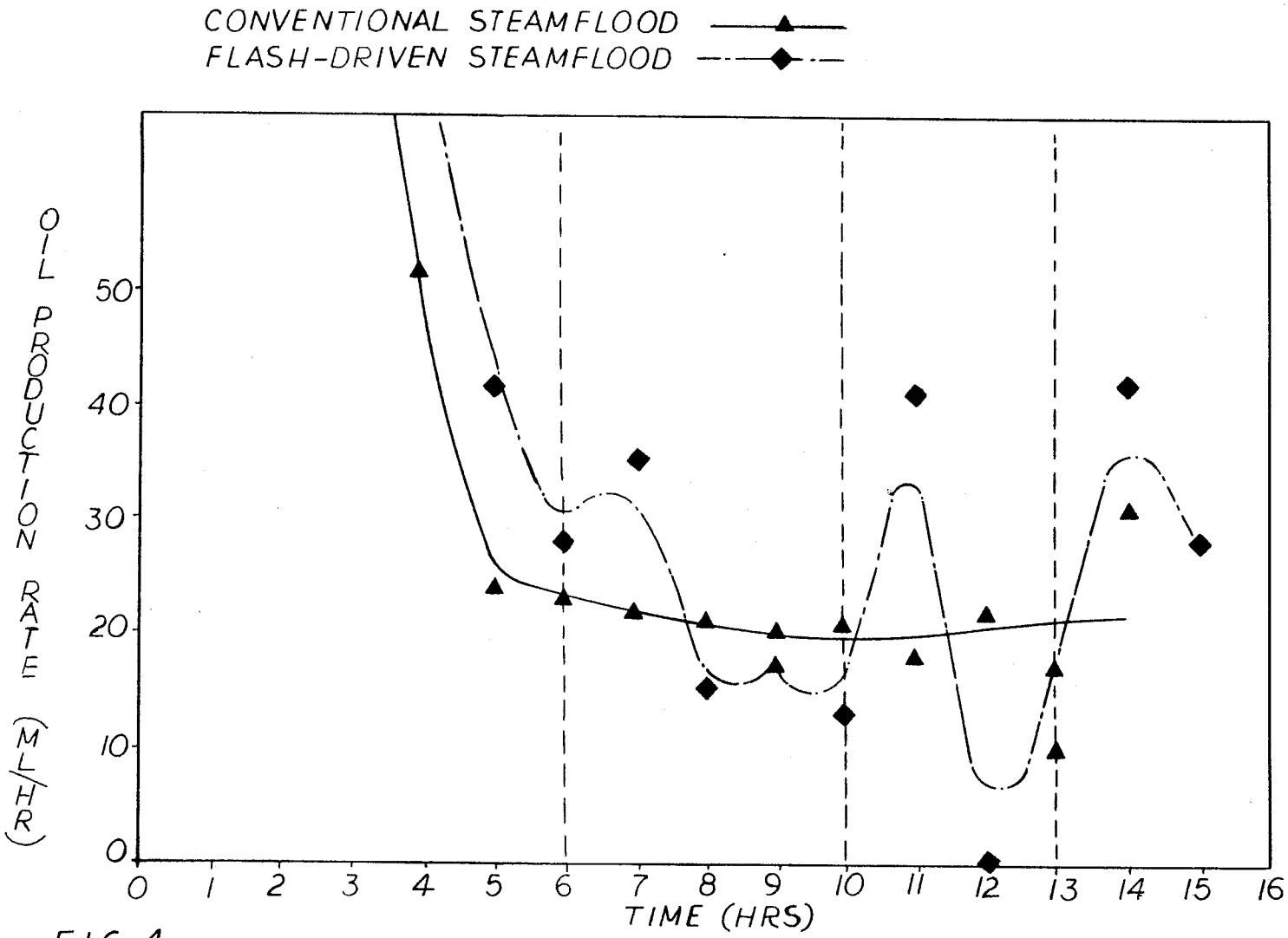
FIG. 4 is a comparison of the oil production rate between conventional steamflooding and the flash-driven steamflooding of the present invention.
Figure 5:
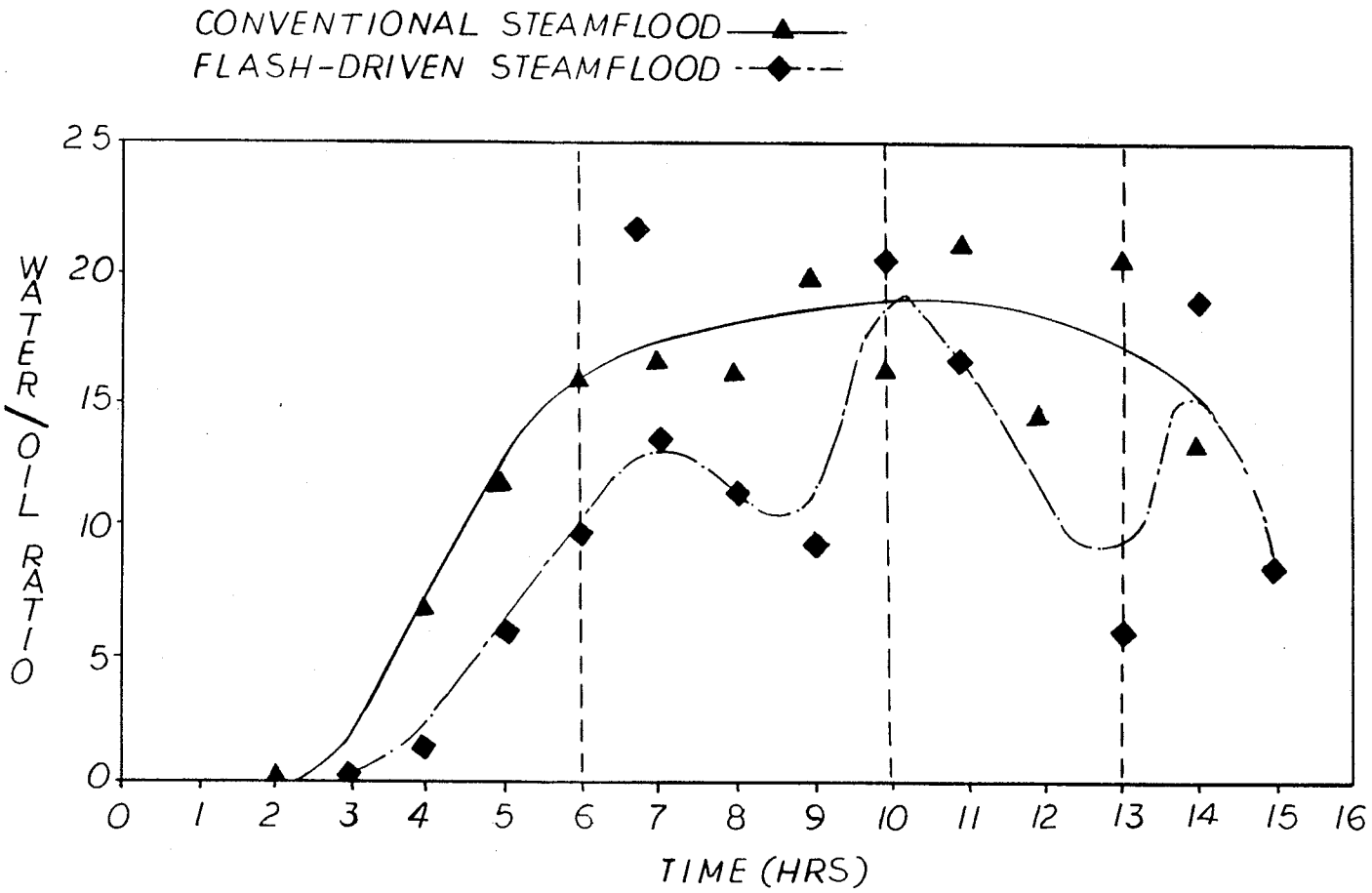
FIG. 5 is a comparison of the water-oil ratio between conventional steamflooding and flash-driven steamflooding of the present invention.

The third set of steamfloods was conducted focusing on oil production and on the boiler's energy consumption. The model was packed with new sand before each run. The permeabilities of the sandpacks of the conventional and flash-driven runs were 2.3 and 2.4 darcies, respectively. The conventional steamflood was run until steam breakthrough occurred at the production end of the model (14 hours). The flash-driven steamflood run was, therefore, terminated after 14 hours. The mass flow rate (m) of steam was 0.612 lbm/hr for the conventional steamflood and 0.564 lbm/hr for the flash-driven steamflood. In order to improve the performance of the flash-driven steamflood, the three stages of the process were cycled through three times. FIG. 4 is a plot of the oil production data versus time for both runs and FIG. 5 is a plot of the hourly water-oil ratios of both methods of steamflooding. A marked improvement in both oil production and water-oil ratios can be seen in the two hours following each initiation of Stage 3 in the flash-driven run. Production data and water-oil ratios for both runs are listed in Table 2. Table 1 (columns 5 and 6) shows the total energy required for both runs. The flash-driven steamflood used 5.4% less energy than the conventional steamflood. Furthermore, the flash-driven steamflood recovered an additional 10.9% of the original oil in place.

TABLE 2

PRODUCTION AND WATER-OIL RATIO DATA FOR THE THIRD SET OF STEAMFLOODS.

| | Control | | | Flash Driven Steamflood | | |
|---|---|---|---|---|---|---|
| TIME (hour) | OIL cc/hr | WATER cc/hr | WOR* | OIL cc/hr | WATER cc/hr | WOR* |
| 1 | 0 | 0 | N/A | 0 | 0 | N/A |
| 2 | 240 | 5 | 0.02 | 191 | 0 | 0.00 |
| 3 | 235 | 69 | 3.41 | 240 | 6 | 0.02 |
| 4 | 52 | 353 | 6.79 | 118 | 158 | 1.34 |
| 5 | 24 | 284 | 11.83 | 42 | 248 | 5.90 |
| 6 | 23 | 284 | 11.83 | 42 | 248 | 5.90 |
| 7 | 22 | 364 | 16.55 | 35 | 467 | 13.34 |
| 8 | 21 | 334 | 15.90 | 15 | 165 | 11.00 |
| 9 | 17 | 336 | 19.76 | 20 | 185 | 9.25 |
| 10 | 21 | 342 | 16.29 | 13 | 265 | 20.38 |
| 11 | 18 | 382 | 21.22 | 41 | 675 | 16.46 |
| 12 | 22 | 315 | 14.32 | 0 | 0 | N/A |
| 13 | 10 | 206 | 20.60 | 17 | 100 | 5.88 |
| 14 | 31 | 407 | 13.13 | 42 | 788 | 18.76 |
| 14.5 | | | | 28 | 232 | 8.29 |
| TOTAL (cc's) | 736 | 3758 | | 830 | 3560 | |

*NOTE

The WOR is the water-oil ratio or the cc's of water produced divided by the cc's of oil produced.

What is claimed is:

1. In a method for recovery of oil from light oil reserves in a subterranean oil-bearing formation by injecting steam into the formation through an injection well and recovering oil from a production well at a distance from the injection well, the improvement comprising:

(a) injecting steam through an injection well into a light oil-bearing formation while gradually reducing the production rate of oil recovered from a production well located at a distance from said injection well so that the pressure in said formation increases at a predetermined rate of from about 5 to about 50 psia per day from an original value to a predetermined maximum value; (b) maintaining injection of said steam through said injection well after increasing the production rate of oil recovered from said production well to a value such that said predetermined maximum pressure value is maintained for a predetermined time; and (c) gradually increasing the production rate of oil recovered from said production well so that the pressure in said formation decreases at a predetermined rate of from about 5 to about 50 psia per day from said predetermined maximum value back down to said original value.

2. A method in accordance with claim 1 wherein the injection of steam through said injection well is maintained during step (c).

3. A method in accordance with claim 1 wherein the injection of steam through said injection well is stopped during step (c).

* * * * *

UNITED STATES PATENT AND TRADEMARK OFFICE

CERTIFICATE OF CORRECTION

PATENT NO. : 4,957,164

DATED : September 18, 1990

INVENTOR(S) : Steven D. Roark

It is certified that error appears in the above-identified patent and that said Letters Patent is hereby corrected as shown below:

Column 3, Line 28, after "'shutting-in'" delete comma.

Column 3, Line 42, after "propagation" insert a period.

Column 4, Line 6, after "et al." insert a comma.

Column 4, Lines 50-51, change "herein below" to --hereinbelow--.

Column 4, Line 63, after "with" delete "a".

Column 5, Line 10, change "80" to --180--.

Column 5, Line 51, in the first line under NOTE:, after "Flash-driven" change "steamfloods" to --steamflood--.

Column 5, Line 55, after "TOTAL =" change "*BTU = *hl*" to --BTU = $*h_1$--.

Column 6, Line 57, after "*NOTE" insert a colon.

Signed and Sealed this

Sixteenth Day of June, 1992

*Attest:*

DOUGLAS B. COMER

*Attesting Officer*

*Acting Commissioner of Patents and Trademarks*